US010627125B2

(12) United States Patent
Jang

(10) Patent No.: US 10,627,125 B2
(45) Date of Patent: Apr. 21, 2020

(54) APPARATUS AND METHOD FOR CONTROLLING AIR CONDITIONING SYSTEM FOR AUTOMOTIVE BODY PAINTING

(71) Applicants: Hyundai Motor Company, Seoul (KR); Kia Motors Corporation, Seoul (KR)

(72) Inventor: Kyung Mo Jang, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 128 days.

(21) Appl. No.: 15/790,925

(22) Filed: Oct. 23, 2017

(65) Prior Publication Data

US 2018/0172302 A1 Jun. 21, 2018

(30) Foreign Application Priority Data

Dec. 15, 2016 (KR) ..... 10-2016-0171735

(51) Int. Cl.
*B05B 16/60* (2018.01)
*F24F 11/30* (2018.01)
(Continued)

(52) U.S. Cl.
CPC ..... *F24F 11/30* (2018.01); *B05B 16/00* (2018.02); *B05B 16/60* (2018.02); *F24F 11/62* (2018.01); *F24F 2110/10* (2018.01); *F24F 2110/12* (2018.01); *F24F 2110/20* (2018.01); *F24F 2110/22* (2018.01)

(58) Field of Classification Search
CPC ..... F24F 2110/00; F24F 2110/10; F24F 2110/12; F24F 2110/20; F24F 2110/22; B05B 16/00; B05B 16/20; B05B 16/60
See application file for complete search history.

(56) References Cited

U.S. PATENT DOCUMENTS 9,205,444 B2 12/2015 Bhattacharya

FOREIGN PATENT DOCUMENTS

JP H0938546 A 2/1997
JP 3272391 B2 4/2002
(Continued)

*Primary Examiner* — Edward F Landrum
*Assistant Examiner* — Daniel C Comings
(74) *Attorney, Agent, or Firm* — Slater Matsil, LLP

(57) ABSTRACT

An apparatus and a method are used for controlling an air conditioning system for automotive body painting to regulate temperature and humidity in a paint booth based on difference between enthalpy of outside air and enthalpy of supply air. The apparatus includes a first temperature sensor measuring temperature of outside air, a first humidity sensor measuring humidity of outside air, a second temperature sensor measuring temperature of supply air, a second humidity sensor measuring humidity of supply air, and a controller calculating first enthalpy based on the temperature and humidity of the outside air, calculating second enthalpy based on the temperature and humidity of the supply air, and controlling the air conditioning system to regulate the temperature and humidity of the supply air when difference between the first enthalpy and the second enthalpy is below or exceeds a reference enthalpy range.

19 Claims, 7 Drawing Sheets

(51) Int. Cl.

| | |
|---|---|
| ***B05B 16/00*** | (2018.01) |
| ***F24F 11/62*** | (2018.01) |
| *F24F 110/20* | (2018.01) |
| *F24F 110/10* | (2018.01) |
| *F24F 110/12* | (2018.01) |
| *F24F 110/22* | (2018.01) |

(56) References Cited

FOREIGN PATENT DOCUMENTS

| | | | | | |
|---|---|---|---|---|---|
| JP | 2010131507 | A | | 6/2010 | |
| JP | 5839483 | B2 | * | 11/2015 | ..... F24F 11/02 |
| JP | 5839483 | B2 | | 1/2016 | |
| KR | 101338451 | B1 | | 12/2013 | |

* cited by examiner

APPARATUS FOR CONTROLLING AIR CONDITION SYSTEM 2016.09.22 19:14:07

| | TEMPERATURE (℃) | HUMIDITY (%) | ENTHALPY (kcal/kg) | ABSOLUTE HUMIDITY (kg/kg) | DEW POINT (℃) |
|---|---|---|---|---|---|
| OUTSIDE AIR1 | 21.5 | 50.3 | 10.053 | 0.008 | 10.74 |
| OUTSIDE AIR2 | 21.5 | 50.3 | 10.053 | 0.008 | 10.74 |

| | TEMPERATURE (℃) | HUMIDITY (%) | ENTHALPY (kcal/kg) | ABSOLUTE HUMIDITY (kg/kg) | DEW POINT (℃) |
|---|---|---|---|---|---|
| AVERAGE OF OUTSIDE AIR | 21.5 | 50.3 | 10.053 | 0.008 | 10.74 |
| WASHER ZONE | 21.5 | 50.3 | 10.053 | 0.008 | 10.74 |

| | ZONE 1 | | | | | ZONE 2 | | | | |
|---|---|---|---|---|---|---|---|---|---|---|
| MIDDLE BOOTH | TEMPERATURE | HUMIDITY | ENTHALPY | ABSOLUTE HUMIDITY | DEW POINT | TEMPERATURE | HUMIDITY | ENTHALPY | ABSOLUTE HUMIDITY | DEW POINT |
| HISTORY PRESENT | 21.5 | 50.3 | 10.053 | 0.008 | 10.74 | 21.5 | 50.3 | 10.053 | 0.008 | 10.74 |
| SET UP SETTING | | | | | | | | | | |
| AUTO SET UP ● WASHER PUMP | OPENING RATIO | 93 | % | RE-HEATER MODE | | OPENING RATIO | 88 | % | RE-HEATER MODE | |
| TOP1 BOOTH | TEMPERATURE | HUMIDITY | ENTHALPY | ABSOLUTE HUMIDITY | DEW POINT | TEMPERATURE | HUMIDITY | ENTHALPY | ABSOLUTE HUMIDITY | DEW POINT |
| HISTORY PRESENT | 21.5 | 50.3 | 10.053 | 0.008 | 10.74 | 21.5 | 50.3 | 10.053 | 0.008 | 10.74 |
| SET UP SETTING | | | | | | | | | | |
| AUTO SET UP ● WASHER PUMP | OPENING RATIO | 40 | % | | | OPENING RATIO | 55 | % | | |
| TOP2 BOOTH | TEMPERATURE | HUMIDITY | ENTHALPY | ABSOLUTE HUMIDITY | DEW POINT | TEMPERATURE | HUMIDITY | ENTHALPY | ABSOLUTE HUMIDITY | DEW POINT |
| HISTORY PRESENT | 21.5 | 50.3 | 10.053 | 0.008 | 10.74 | 21.5 | 50.3 | 10.053 | 0.008 | 10.74 |
| SET UP SETTING | | | | | | | | | | |
| AUTO SET UP ● WASHER PUMP | OPENING RATIO | 59 | % | | | OPENING RATIO | 74 | % | | |

FIG.3

| APPARATUS FOR CONTROLLING AIR CONDITION SYSTEM | | | | | | | | | | 2016.09.22 19:14:07 |
|---|---|---|---|---|---|---|---|---|---|---|
| | MIDDLE BOOTH | | | | | AVERAGE OF OUTSIDE AIR | | | | |
| DATE | TEMPERATURE | HUMIDITY | ENTHALPY | ABSOLUTE HUMIDITY | DEW POINT | TEMPERATURE | HUMIDITY | ENTHALPY | ABSOLUTE HUMIDITY | DEW POINT |
| 2016-09-10 11:21 | 28 | 60 | 15.45 | 0.014 | 19.52 | 20 | 56.5 | 9.807 | 0.008 | 11.1 |
| 2016-09-10 11:22 | 20.5 | 68 | 11.156 | 0.01 | 14.4 | 23.5 | 51.5 | 12.437 | 0.011 | 15.68 |
| 2016-09-10 11:23 | 24 | 60 | 12.598 | 0.011 | 15.76 | 27 | 58.5 | 14.488 | 0.013 | 18.18 |
| 2016-09-10 11:24 | 25.5 | 58 | 13.365 | 0.012 | 16.64 | 23.5 | 57 | 11.932 | 0.01 | 14.3 |
| 2016-09-10 11:25 | 26 | 60 | 13.972 | 0.013 | 17.64 | 28.5 | 57.5 | 15.454 | 0.014 | 19.3 |
| 2016-09-10 11:51 | 27.5 | 59 | 14.926 | 0.014 | 18.78 | 23.5 | 58 | 12.044 | 0.011 | 14.77 |
| 2016-09-10 11:52 | 24 | 61.5 | 12.771 | 0.012 | 16.15 | 23 | 56.5 | 11.566 | 0.01 | 13.9 |
| 2016-09-10 11:53 | 20.5 | 55 | 9.949 | 0.008 | 11.16 | 23.5 | 61 | 12.381 | 0.011 | 15.55 |
| 2016-09-10 11:54 | 24 | 60 | 12.598 | 0.011 | 15.76 | 25.5 | 59.5 | 13.555 | 0.012 | 17.04 |
| 2016-09-10 11:55 | 21.5 | 62 | 11.208 | 0.01 | 13.92 | 27 | 65.5 | 15.468 | 0.015 | 19.99 |
| 2016-09-10 11:56 | 21 | 60 | 10.709 | 0.009 | 12.95 | 26.5 | 57 | 13.925 | 0.012 | 17.3 |
| 2016-09-10 11:57 | 23.5 | 54 | 11.596 | 0.01 | 13.67 | 21 | 65 | 11.188 | 0.01 | 14.18 |
| 2016-09-10 11:58 | 26 | 61.5 | 12.169 | 0.013 | 18.03 | 23 | 53.5 | 11.24 | 0.009 | 13.06 |
| 2016-09-10 11:59 | 27.5 | 59 | 14.926 | 0.014 | 18.78 | 25 | 55.5 | 13.513 | 0.012 | 16.69 |
| 2016-09-10 12:00 | 26 | 60 | 13.972 | 0.013 | 17.64 | 24.5 | 62.5 | 13.231 | 0.012 | 16.88 |
| 2016-09-10 12:01 | 22.5 | 67 | 12.368 | 0.011 | 16.07 | 25.5 | 67 | 14.513 | 0.014 | 18.93 |
| 2016-09-10 12:02 | 29 | 64.5 | 16.944 | 0.016 | 21.63 | 24 | 61.5 | 12.771 | 0.012 | 16.15 |
| 2016-09-10 12:03 | 27.5 | 64 | 15.648 | 0.015 | 20.09 | 25 | 58.5 | 13.087 | 0.012 | 15.31 |
| 2016-09-10 12:04 | 23 | 60.5 | 12 | 0.011 | 14.95 | 22.5 | 59 | 11.523 | 0.01 | 14.1 |
| 2016-09-10 12:05 | 27.5 | 61 | 15.215 | 0.014 | 19.31 | 29 | 56.5 | 15.679 | 0.014 | 19.48 |

FIG.6

APPARATUS AND METHOD FOR CONTROLLING AIR CONDITIONING SYSTEM FOR AUTOMOTIVE BODY PAINTING

CROSS-REFERENCE TO RELATED APPLICATIONS

This application claims priority to Korean Patent Application No. 10-2016-0171735, filed on Dec. 15, 2016, in the Korean Intellectual Property Office, which application is hereby incorporated herein by reference.

TECHNICAL FIELD

The present disclosure relates to an apparatus and a method for controlling an air conditioning system for automotive body painting.

BACKGROUND

In general, a painting process in an automobile production line is to prevent corrosion of a vehicle body and increase merchantable quality by enhancing the beauty of a vehicle along with soundproofing.

In a painting line to which the painting process is applied, a paint film may be formed on the vehicle body by applying the following coats: an undercoat through electrodeposition, which is an important factor in anti-rusting and surface gloss of the vehicle body passing through a drying furnace in a pretreatment step; an intermediate coat for imparting chipping resistance, smoothness, weatherability, and the like of paint after application of a sealer; a top coat for glossy coating in view of the attractive exterior appearance of the vehicle; and a clearcoat.

The painting line is provided with a paint booth equipped with an air supply/exhaust device for smooth painting operation of the vehicle body in the step of applying the intermediate and top coats. The paint booth receives air of constant temperature and humidity through an air conditioning system.

The air conditioning system includes a burner section, a washer section, a cooling section, a heating section, a humidifying section, and the like. Outside air from which foreign materials have been removed through a filter may pass through each of the sections such that temperature and humidity are controlled, and thus the air of constant temperature and humidity required by the paint booth may be supplied to the paint booth. The air supplied to the paint booth is called "supply air."

Such a conventional air conditioning system may consume excessive energy because it supplies the air of constant temperature and humidity to the paint booth, regardless of the temperature and humidity conditions of the outside air.

SUMMARY

The present disclosure relates to an apparatus and a method for controlling an air conditioning system for automotive body painting and, in particular embodiments, to a technique for efficiently operating an air conditioning system for automotive body painting to control temperature and humidity in a paint booth.

Embodiments can solve above-mentioned problems occurring in the prior art while maintaining advantages achieved by the prior art.

An aspect of the present disclosure provides an apparatus and a method for controlling an air conditioning system for automotive body painting in a manner that controls the air conditioning system for automotive body painting to regulate the temperature and humidity of air (hereinafter referred to as the "supply air") that is supplied to a paint booth on the basis of a difference between the enthalpy of the outside air and the enthalpy of the supply air, thereby preventing excessive energy consumption and allowing for efficient operation.

The embodiments of the present disclosure are not limited to the foregoing embodiments, and other embodiments and advantages not mentioned herein will be clearly understood from the following description. The present inventive concept will be more clearly understood from exemplary embodiments of the present disclosure. In addition, it will be apparent that the embodiments and advantages of the present disclosure can be achieved by elements and features claimed in the claims and a combination thereof.

According to an aspect of the present disclosure, and apparatus can be used for for controlling an air conditioning system for automotive body painting to regulate the temperature and humidity of the supply air to within respective reference ranges when a difference between the enthalpy of the outside air and the enthalpy of the supply air is below or exceeds a reference enthalpy range.

The apparatus for controlling an air conditioning system for automotive body painting may include a first temperature sensor measuring a temperature of the outside air, a first humidity sensor measuring a humidity of the outside air, a second temperature sensor measuring a temperature of the supply air, a second humidity sensor measuring a humidity of the supply air, and a controller calculating first enthalpy on the basis of the temperature and humidity of the outside air, calculating second enthalpy on the basis of the temperature and humidity of the supply air, and controlling the air conditioning system for automotive body painting to regulate the temperature and humidity of the supply air when a difference between the first enthalpy and the second enthalpy is below or exceeds a reference enthalpy range.

The controller may regulate the temperature and humidity of the supply air on the basis of a total cycle including a temperature control cycle and a humidity control cycle.

The controller may transmit a reference control temperature to the air conditioning system for automotive body painting according to the temperature control cycle, and then transmit a reference control humidity to the air conditioning system for automotive body painting according to the humidity control cycle.

The controller may transmit the reference control temperature to the air conditioning system for automotive body painting until the temperature of the supply air is within a reference temperature range.

The controller may transmit the reference control humidity to the air conditioning system for automotive body painting until the humidity of the supply air is within a reference humidity range.

According to another aspect of the present disclosure, there is provided a method for controlling an air conditioning system for automotive body painting to regulate the temperature and humidity of the supply air to within respective reference ranges when a difference between the enthalpy of the outside air and the enthalpy of the supply air is below or exceeds a reference enthalpy range.

The method for controlling an air conditioning system for automotive body painting, may include measuring, by a first temperature sensor, a temperature of the outside air; measuring, by a first humidity sensor, a humidity of the outside air; measuring, by a second temperature sensor, a temperature of the supply air; measuring, by a second humidity sensor, a humidity of the supply air; and calculating, by a controller, first enthalpy on the basis of the temperature and humidity of the outside air, calculating second enthalpy on the basis of the temperature and humidity of the supply air, and controlling the air conditioning system for automotive body painting to regulate the temperature and humidity of the supply air when a difference between the first enthalpy and the second enthalpy is below or exceeds a reference enthalpy range.

The controlling step may include regulating the temperature and humidity of the supply air on the basis of a total cycle including a temperature control cycle and a humidity control cycle.

The controlling step may include transmitting a reference control temperature to the air conditioning system for automotive body painting according to the temperature control cycle, and transmitting a reference control humidity to the air conditioning system for automotive body painting according to the humidity control cycle.

The controlling step may include transmitting the reference control temperature to the air conditioning system for automotive body painting until the temperature of the supply air is within a reference temperature range.

The controlling step may include transmitting the reference control humidity to the air conditioning system for automotive body painting until the humidity of the supply air is within a reference humidity range.

BRIEF DESCRIPTION OF THE DRAWINGS

The above and other objects, features and advantages of the present disclosure will be more apparent from the following detailed description taken in conjunction with the accompanying drawings:

FIG. 3 illustrates a window for control of an air conditioning system for automotive body painting, according to an exemplary embodiment of the present disclosure;

FIG. 6 illustrates a control history of an air conditioning system for automotive body painting, according to another exemplary embodiment of the present disclosure.

DETAILED DESCRIPTION OF ILLUSTRATIVE EMBODIMENTS

The above and other objects, features, and advantages of the present disclosure will be more clearly understood from the following detailed description taken in conjunction with the accompanying drawings so that those skilled in the art to which the present disclosure pertains can easily implement technical ideas described herein. In addition, a detailed description of well-known techniques associated with the present disclosure will be ruled out in order not to unnecessarily obscure the gist of the present disclosure. Hereinafter, exemplary embodiments of the present disclosure will be described in detail with reference to the accompanying drawings.

Figure 1:
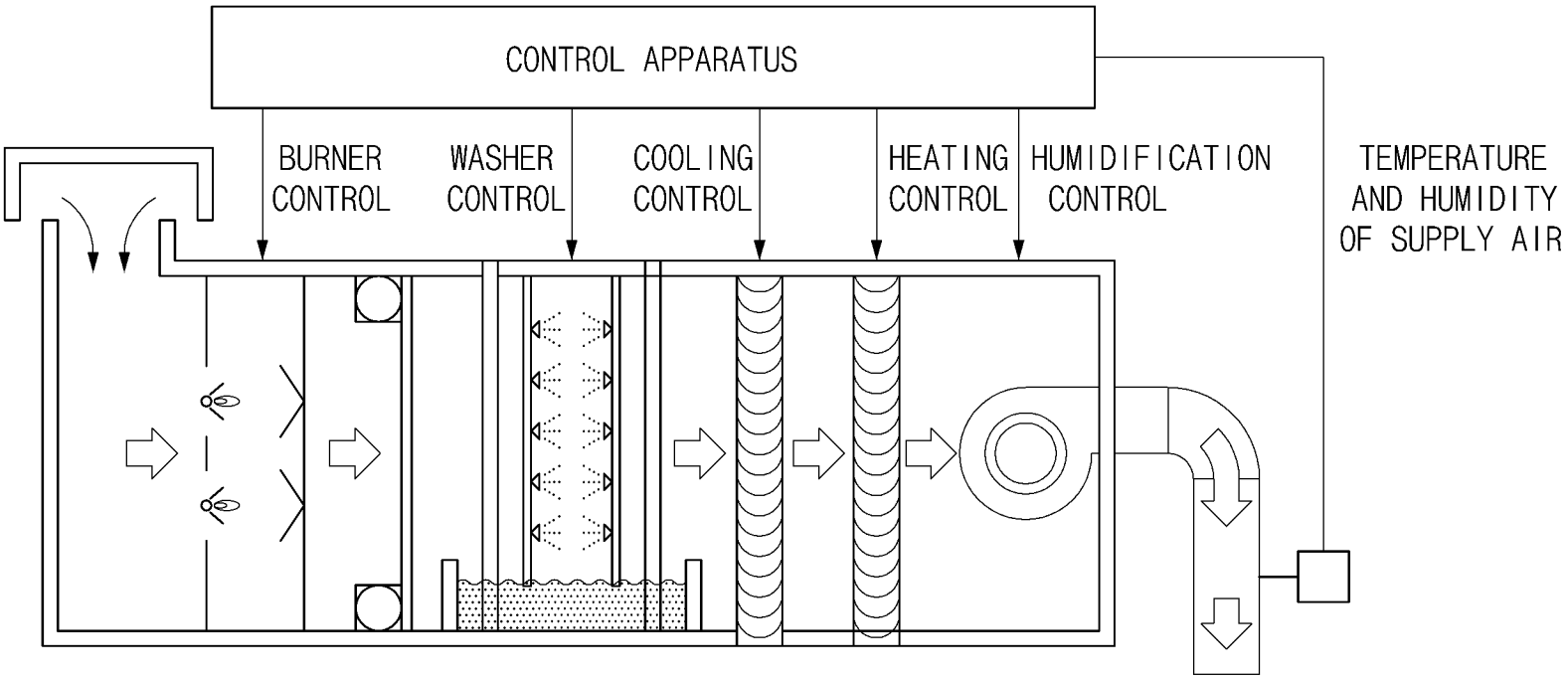
FIG. 1 illustrates an example of an air conditioning system for automotive body painting to which the present inventive concept is applied.

FIG. 1 illustrates an example of an air conditioning system for automotive body painting to which the present inventive concept is applied.

As illustrated in FIG. 1, an air conditioning system for automotive body painting to which the present inventive concept is applied may perform the overall air conditioning process to allow outside air to have a set temperature and a set humidity while passing through a burner section, a washer section, a cooling section, a heating section, and a humidifying section. Through this process, the air having the set temperature and the set humidity may be supplied to a paint booth. Here, the air supplied to the paint booth is referred to as "supply air."

Such an air conditioning system for automotive body painting may be controlled by a control apparatus according to an exemplary embodiment of the present disclosure. In other words, it may control the temperature and humidity of the supply air only when a difference between enthalpy of the outside air and enthalpy of the supply air is below or exceeds a reference enthalpy range (for example, 0.35 to 0.4) set by the control apparatus.

Here, a temperature to be set for each temperature control cycle may be a maximum allowable temperature of ±2° C., but it may, for example, preferably be ±0.5° C.; and a humidity to be set for each humidity control cycle may be a maximum allowable humidity of ±2%, but it may, for example, preferably be ±0.5%. Here, the combination of the temperature control cycle and the humidity control cycle may constitute one total cycle. For example, if the total cycle is 20 minutes, each of the temperature control cycle and the humidity control cycle is 10 minutes.

In addition, when regulating the temperature and humidity of the supply air under the control of the control apparatus, the air conditioning system for automotive body painting may regulate the temperature in the temperature control cycle and then regulate the humidity in the humidity control cycle sequentially, or may regulate the humidity in the humidity control cycle and then regulate the temperature in the temperature control cycle sequentially, without regulating the temperature and humidity simultaneously. The temperature control process may end when the temperature of the supply air is within a reference temperature range, and the humidity control process may end when the humidity of the supply air is within a reference humidity range.

Figure 2:
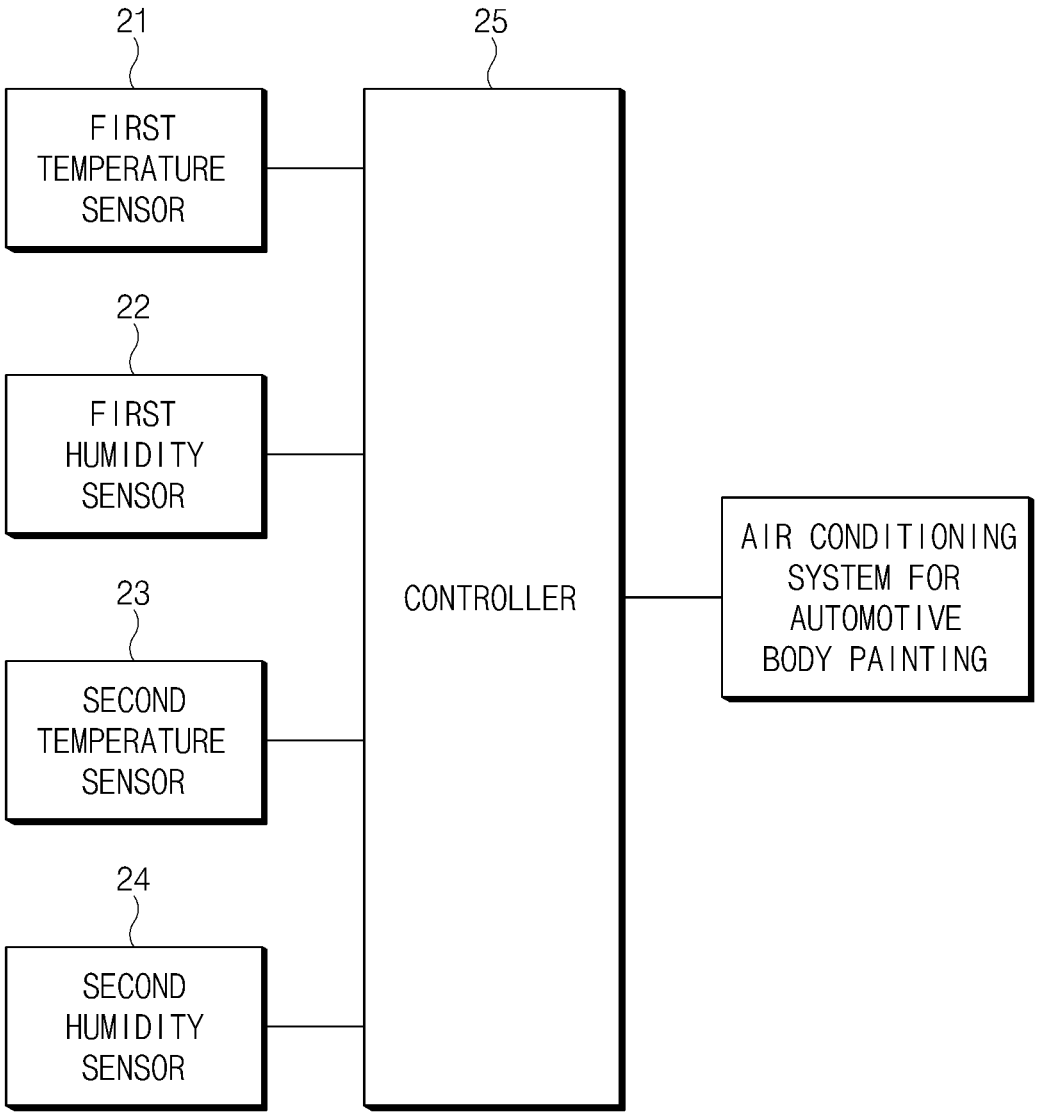
FIG. 2 illustrates the configuration of an apparatus for controlling an air conditioning system for automotive body painting, according to an exemplary embodiment of the present disclosure.

FIG. 2 illustrates the configuration of an apparatus for controlling an air conditioning system for automotive body painting, according to an exemplary embodiment of the present disclosure.

As illustrated in FIG. 2, the apparatus for controlling an air conditioning system for automotive body painting, according to the exemplary embodiment of the present disclosure, includes a first temperature sensor 21, a first humidity sensor 22, a second temperature sensor 23, a second humidity sensor 24, and a controller 25.

With regard to each of the aforementioned elements, first, the first temperature sensor 21 may measure a temperature of the outside air.

The first humidity sensor 22 may measure a humidity of the outside air. Wherein the humidity may be absolute humidity.

The second temperature sensor 23 may measure a temperature of the supply air.

The second humidity sensor 24 may measure a humidity of the supply air. Wherein the humidity may be absolute humidity.

Next, the controller 25 generally controls the aforementioned respective elements to perform the functions thereof normally.

In particular, the controller 25 may calculate first enthalpy on the basis of the temperature of the outside air measured by the first temperature sensor 21 and the humidity of the outside air measured by the first humidity sensor 22, and may calculate second enthalpy on the basis of the temperature of the supply air measured by the second temperature sensor 23 and the humidity of the supply air measured by the second humidity sensor 24. The controller 25 may calculate enthalpy E based on a following equation 1.

$$E=(C1\times T)+K(L+C2\times T) \quad \text{[Equation 1]}$$

In this case, the C1 represents a specific heat of air at the T, the T represents a temperature of the outside air, the K represents an absolute humidity, the L represents a latent heat of water evaporation at the T, the C2 represents specific heat of saturated water vapor at the T.

In addition, the controller 25 may control the air conditioning system for automotive body painting to regulate the temperature and humidity of the supply air when a difference between the first enthalpy and the second enthalpy is below or exceeds a reference enthalpy range (for example, 0.35 to 0.4). Here, when the difference between the first enthalpy and the second enthalpy is within the reference enthalpy range, the process of regulating the temperature and humidity of the supply air may not be performed.

In addition, when controlling the air conditioning system for automotive body painting to regulate the temperature and humidity of the supply air, the controller 25 may transmit a reference control temperature to the air conditioning system according to the temperature control cycle, and then transmit a reference control humidity to the air conditioning system according to the humidity control cycle. Then, the air conditioning system for automotive body painting may regulate the temperature of the supply air by the reference control temperature in the temperature control cycle, and then regulate the humidity of the supply air by the reference control humidity in the humidity control cycle. Here, the order/sequence of the temperature control cycle and the humidity control cycle has no effect on the present inventive concept.

The temperature control process may end when the temperature of the supply air is within a reference temperature range, and the humidity control process may end when the humidity of the supply air is within a reference humidity range.

For example, the following conditions are given: the total cycle is 20 minutes; the temperature control cycle is 10 minutes; the humidity control cycle is 10 minutes; the supply air temperature needs to be increased by 5° C.; and the supply air humidity needs to be increased by 5%. First of all, 0.5° C. as the reference control temperature is transmitted to the air conditioning system in the temperature control cycle. Then, the air conditioning system increases a current temperature of the supply air by 0.5° C. Here, the temperature control cycle may appropriately be set to allow the air conditioning system to regulate the temperature of the supply air by the reference control temperature within the temperature control cycle.

Thereafter, 0.5% as the reference control humidity is transmitted to the air conditioning system in the humidity control cycle. Then, the air conditioning system increases a current humidity of the supply air by 0.5%. Here, the humidity control cycle may appropriately be set to allow the air conditioning system to regulate the humidity of the supply air by the reference control humidity within the humidity control cycle.

Throughout one cycle (20 minutes), the temperature has been increased by 0.5° C., and the humidity has been increased by 0.5%. Thus, it is still necessary to increase the temperature by 4.5° C. and increase the humidity by 4.5%, so a total of 10 cycles is required to finally complete the process.

The reason why the temperature and the humidity are sequentially controlled in the total of cycles is to increase energy consumption efficiency. Alternatively, the temperature and the humidity may be controlled simultaneously after halving the total of cycles.

Figure 4:
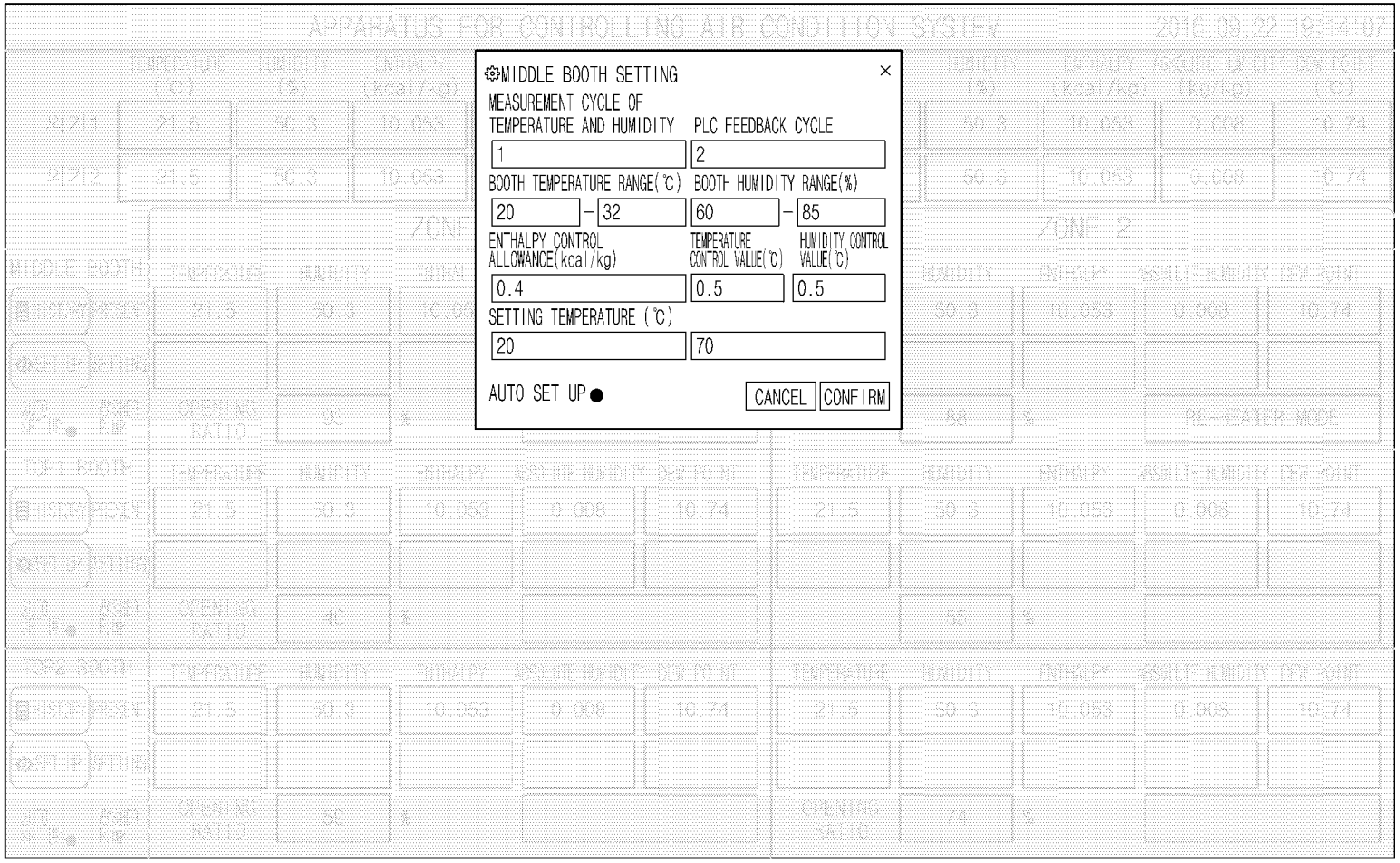
FIG. 4 illustrates an information setting window provided by an apparatus for controlling an air conditioning system for automotive body painting, according to an exemplary embodiment of the present disclosure.

Meanwhile, the controller 25 may provide a control window as illustrated in FIG. 3, and may provide a window for setting reference information as illustrated in FIG. 4.

Figure 5:
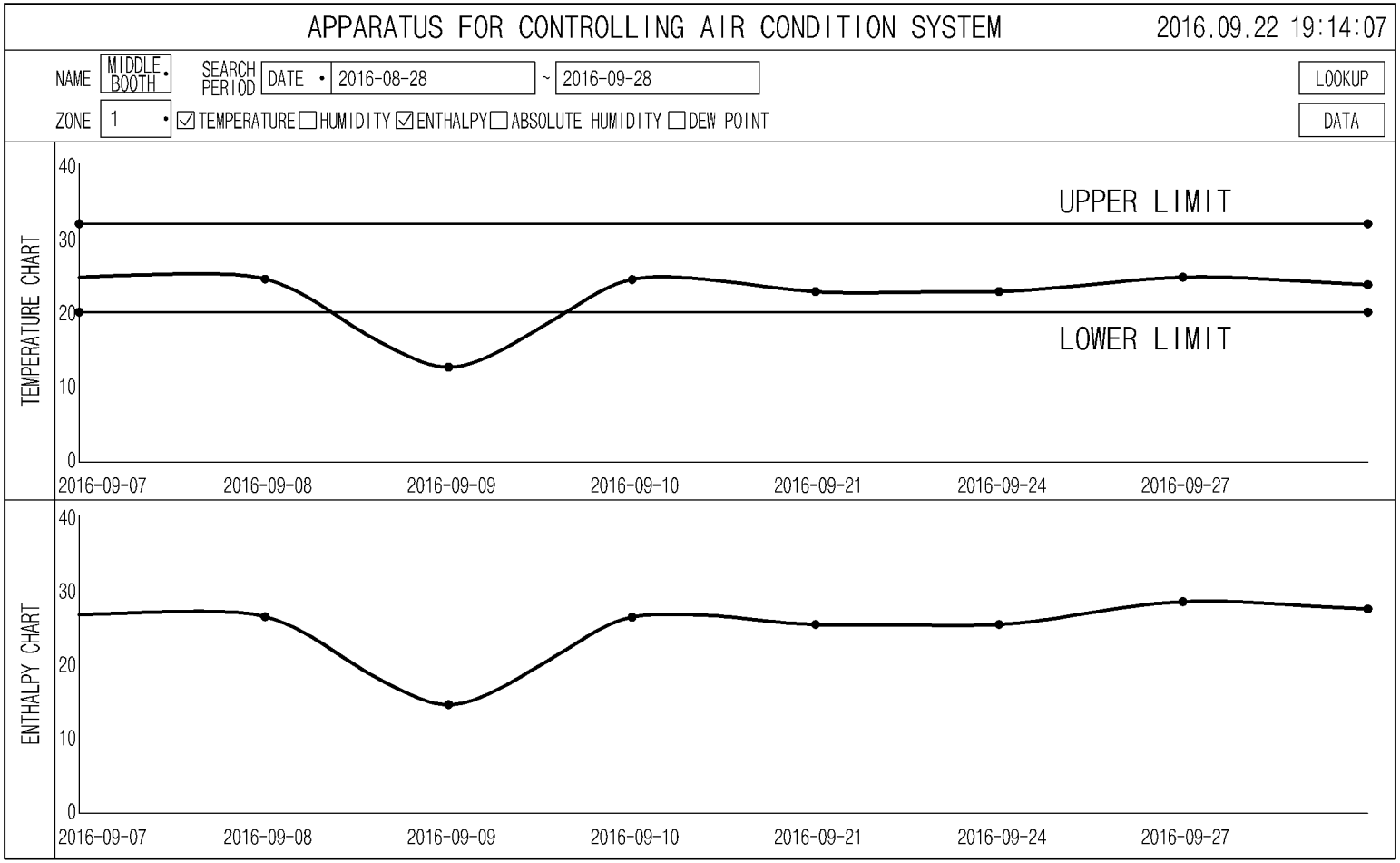
FIG. 5 illustrates a control history of an air conditioning system for automotive body painting, according to an exemplary embodiment of the present disclosure.

In addition, the controller 25 may provide a user with a control history of the air conditioning system for automotive body painting in the form of a graph as illustrated in FIG. 5, and may provide the user with a control history of the air conditioning system for automotive body painting in the form of a table as illustrated in FIG. 6.

Figure 7:
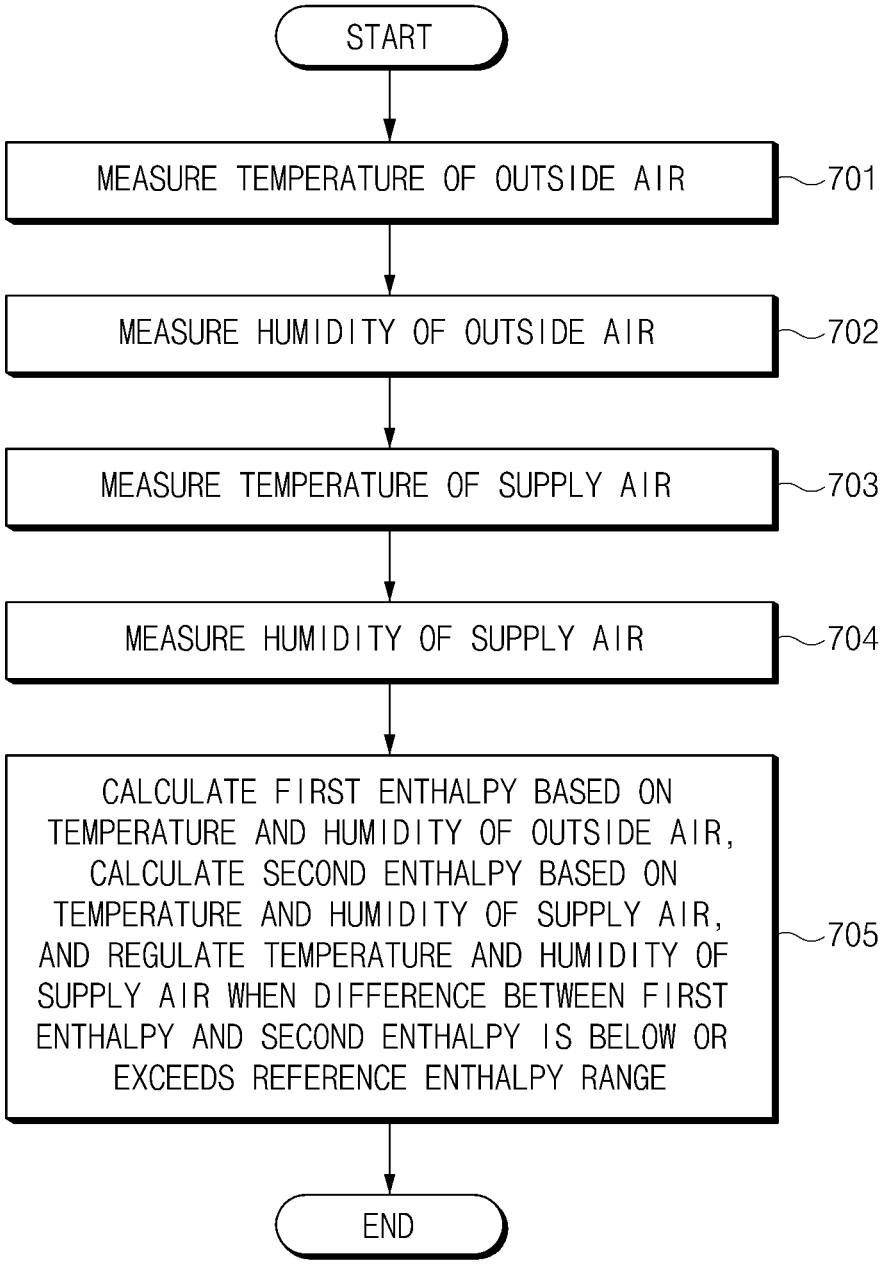
FIG. 7 illustrates a flowchart of a method for controlling an air conditioning system for automotive body painting, according to an exemplary embodiment of the present disclosure.

FIG. 7 illustrates a flowchart of a method for controlling an air conditioning system for automotive body painting, according to an exemplary embodiment of the present disclosure.

First of all, the first temperature sensor 21 may measure a temperature of the outside air in operation 701.

The first humidity sensor 22 may measure a humidity of the outside air in operation 702.

The second temperature sensor 23 may measure a temperature of the supply air in operation 703.

The second humidity sensor 24 may measure a humidity of the supply air in operation 704.

Thereafter, the controller 25 may calculate first enthalpy on the basis of the temperature and humidity of the outside air, and calculate second enthalpy on the basis of the temperature and humidity of the supply air. When a difference between the first enthalpy and the second enthalpy is below or exceeds a reference enthalpy range, the controller 25 may control the air conditioning system for automotive body painting to regulate the temperature and humidity of the supply air in operation 705.

Meanwhile, the above-stated method according to the exemplary embodiment of the present disclosure may be written as a computer program. Codes and code segments constituting the program may easily be inferred by a computer programmer skilled in the art. The written program may be stored in a computer-readable recording medium (an information storage medium) and be read and executed by a computer, thereby implementing the method according to the exemplary embodiment of the present disclosure. The recording medium includes all types of computer-readable recording media.

As set forth above, by controlling the air conditioning system for automotive body painting to regulate the temperature and humidity of the air in the paint booth on the basis of the difference between the enthalpy of the outside air and the enthalpy of the supply air, excessive energy consumption may be prevented and efficient operation may be achieved.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. An apparatus for controlling an air conditioning system for automotive body painting, the apparatus comprising:

a first temperature sensor configured to measure a temperature of outside air;

a first humidity sensor configured to measure a humidity of the outside air;

a second temperature sensor configured to measure a temperature of supply air that is supplied to a paint booth;

a second humidity sensor configured to measure a humidity of the supply air; and a controller configured to calculate a first enthalpy based on the temperature and humidity of the outside air, to calculate a second enthalpy based on the temperature and humidity of the supply air, and to control the air conditioning system for automotive body painting to regulate the temperature and humidity of the supply air when a difference between the first enthalpy and the second enthalpy is outside a reference enthalpy range, wherein the controller is configured to alternately perform a process of regulating the temperature of the supply air by a reference control temperature and a process of regulating the humidity of the supply air by a reference control humidity.

2. The apparatus according to claim 1, wherein the controller is configured to regulate the temperature and humidity of the supply air based on a total cycle including a temperature control cycle and a humidity control cycle.

3. The apparatus according to claim 2, wherein the controller is configured to transmit the reference control temperature to the air conditioning system for automotive body painting according to the temperature control cycle, and then to transmit the reference control humidity to the air conditioning system for automotive body painting according to the humidity control cycle.

4. The apparatus according to claim 3, wherein the controller is configured to transmit the reference control temperature to the air conditioning system for automotive body painting until the temperature of the supply air is within a reference temperature range.

5. The apparatus according to claim 3, wherein the controller is configured to transmit the reference control humidity to the air conditioning system for automotive body painting until the humidity of the supply air is within a reference humidity range.

6. A method for controlling an air conditioning system for automotive body painting, the method comprising:

measuring a temperature of outside air;

measuring a humidity of the outside air;

measuring a temperature of supply air that is supplied to a paint booth;

measuring a humidity of the supply air;

determining a first enthalpy based on the temperature and humidity of the outside air;

determining a second enthalpy based on the temperature and humidity of the supply air; and controlling the air conditioning system for automotive body painting to regulate the temperature and humidity of the supply air when a difference between the first enthalpy and the second enthalpy is outside a reference enthalpy range, wherein the controlling comprises alternately performing a process of regulating the temperature of the supply air by a reference control temperature and a process of regulating the humidity of the supply air by a reference control humidity.

7. The method according to claim 6, wherein the temperature of the outside air is measured by a first temperature sensor, wherein the humidity of the outside air is measured by a first humidity sensor, wherein the temperature of the supply air is measured by a second temperature sensor, and wherein the humidity of the supply air is measured by a second humidity sensor.

8. The method according to claim 6, wherein the controlling comprises regulating the temperature and humidity of the supply air based on a total cycle including a temperature control cycle and a humidity control cycle.

9. The method according to claim 8, wherein the controlling comprises:

transmitting the reference control temperature to the air conditioning system for automotive body painting according to the temperature control cycle; and transmitting the reference control humidity to the air conditioning system for automotive body painting according to the humidity control cycle.

10. The method according to claim 9, wherein the controlling comprises transmitting the reference control temperature to the air conditioning system for automotive body painting until the temperature of the supply air is within a reference temperature range.

11. The method according to claim 10, wherein the controlling further comprises transmitting the reference control humidity to the air conditioning system for automotive body painting until the humidity of the supply air is within a reference humidity range.

12. The method according to claim 9, wherein the controlling comprises transmitting the reference control humidity to the air conditioning system for automotive body painting until the humidity of the supply air is within a reference humidity range.

13. A method for making a vehicle, the method comprising:

providing a vehicle body;

performing a painting process to apply a paint film on the vehicle body;

disposing the vehicle in an air conditioning system;

measuring a temperature of outside air external to the air conditioning system;

measuring a humidity of the outside air;

measuring a temperature of supply air that is supplied to the air conditioning system;

measuring a humidity of the supply air;

determining a first enthalpy based on the temperature and humidity of the outside air;

determining a second enthalpy based on the temperature and humidity of the supply air; and controlling the air conditioning system for automotive body painting to regulate the temperature and humidity of the supply air when a difference between the first enthalpy and the second enthalpy is outside a reference enthalpy range, wherein the controlling comprises alternately performing a process of regulating the temperature of the supply air by a reference control temperature and a process of regulating the humidity of the supply air by a reference control humidity.

14. The method according to claim 13, wherein the painting process is performed in a paint booth and wherein disposing the vehicle in the air conditioning system comprises disposing the vehicle in the paint booth.

15. The method according to claim 13, wherein the controlling comprises regulating the temperature and humidity of the supply air based on a total cycle including a temperature control cycle and a humidity control cycle.

16. The method according to claim 15, wherein the controlling comprises:

transmitting the reference control temperature to the air conditioning system for automotive body painting according to the temperature control cycle; and transmitting the reference control humidity to the air conditioning system for automotive body painting according to the humidity control cycle.

17. The method according to claim 16, wherein the controlling comprises transmitting the reference control temperature to the air conditioning system for automotive body painting until the temperature of the supply air is within a reference temperature range.

18. The method according to claim 17, wherein the controlling further comprises transmitting the reference control humidity to the air conditioning system for automotive body painting until the humidity of the supply air is within a reference humidity range.

19. The method according to claim 16, wherein the controlling comprises transmitting the reference control humidity to the air conditioning system for automotive body painting until the humidity of the supply air is within a reference humidity range.

* * * * *